US008808795B2

(12) United States Patent
Higashi et al.

(10) Patent No.: US 8,808,795 B2
(45) Date of Patent: Aug. 19, 2014

(54) METHOD OF PRODUCING LAMINATE FILM

(75) Inventors: Ryochi Higashi, Minami-Ashigara (JP); Kazuhiro Oki, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 776 days.

(21) Appl. No.: 13/034,270

(22) Filed: Feb. 24, 2011

(65) Prior Publication Data

US 2011/0206837 A1 Aug. 25, 2011

(30) Foreign Application Priority Data

Feb. 25, 2010 (JP) ..... 2010-040635

(51) Int. Cl.

| | |
|---|---|
| ***B05D 5/06*** | (2006.01) |
| ***B05D 1/26*** | (2006.01) |
| ***B05D 7/04*** | (2006.01) |
| ***B05D 1/36*** | (2006.01) |

(52) U.S. Cl.

CPC .. *B05D 7/04* (2013.01); *B05D 1/26* (2013.01); *B05D 2252/02* (2013.01); *B05D 1/36* (2013.01)

USPC ..... 427/162; 427/356; 427/402; 118/68

(58) Field of Classification Search

USPC ..... 427/356, 402, 162–169; 118/68

See application file for complete search history.

(56) References Cited

U.S. PATENT DOCUMENTS

| | | | | |
|---|---|---|---|---|
| 5,670,214 | A * | 9/1997 | Saito et al. | 427/356 |
| 6,251,484 | B1 * | 6/2001 | Suzuki et al. | 427/358 |
| 6,548,117 | B2 * | 4/2003 | Tomaru et al. | 427/356 |

FOREIGN PATENT DOCUMENTS

| | | |
|---|---|---|
| JP | 8-168719 | 7/1996 |
| JP | 3314965 | 6/2002 |
| JP | 2003-260400 | 9/2003 |

* cited by examiner

*Primary Examiner* — Elizabeth Burkhart
(74) *Attorney, Agent, or Firm* — Young & Thompson

(57) ABSTRACT

A method of producing a laminate film includes coating a support with coating solutions with at least two monolayer extrusion dies to provide layers. A difference in solubility parameter between the coating solution and a solute in the adjoining layer ≥0.1 for respective coating solutions. Viscosity of the downstream side die coating solution is lower than that of an upstream side die. Each coating solution has a Capillary number Ca<1.7. A difference in surface tension $|\sigma2-\sigma1|$ between the adjoining layers satisfies $|\sigma2-\sigma1|>0.5$ [mN/m], where σ1, σ2 are surface tensions of coating solution from upstream and downstream side dies, respectively. A ratio of a coating thickness $h_1$ [μm] of the coating solution for an upper layer and a distance L [μm] of the upper layer from the support surface satisfies $h_1/L<0.14$. Distance between discharge nozzles is ≥1 mm and ≤700 mm.

6 Claims, 7 Drawing Sheets

FIG.3A

| | COATING METHOD | DIFFERENCE IN SOLUBILITY PARAMETER | INITIAL VISCOSITY RATIO OF UPPER LAYER TO LOWER LAYER (UPPER LAYER/LOWER LAYER) | Ca OF UPPER LAYER | Ca OF LOWER LAYER | DIFFERENCE IN SURFACE TENSION BETWEEN UPPER AND LOWER LAYERS [mN/m] | RATIO OF WET COATING THICKNESS OF UPPER LAYER TO DISTANCE TO SUPPORT | DISTANCE BETWEEN DISCHARGE NOZZLES OF ADJOINING DIES [mm] | WHITENING RESULTING FROM BLENDING OF LAYERS | STREAKS | STEPS | OVERALL RATING | REMARKS |
|---|---|---|---|---|---|---|---|---|---|---|---|---|---|
| EXAMPLE1 | THIS METHOD | 0.15 | 1.2 | 1.3 | 1.5 | 0.6 | 0.13 | 10 | A | A | A | A | |
| COMPARATIVE EXAMPLE1 | SIMULTANEOUS MULTIPLE LAYER COATING | 0.15 | 1.2 | 1.3 | 1.5 | 0.6 | 0.13 | 10 | A | F | F | F | High-frequency steps |
| COMPARATIVE EXAMPLE2 | THIS METHOD | 0 | 1.2 | 1.3 | 1.5 | 0.6 | 0.13 | 10 | F | A | A | F | |
| COMPARATIVE EXAMPLE3 | THIS METHOD | 0.05 | 1.2 | 1.3 | 1.5 | 0.6 | 0.13 | 10 | F | A | A | F | |
| EXAMPLE2 | THIS METHOD | 0.1 | 1.2 | 1.3 | 1.5 | 0.6 | 0.13 | 10 | A | A | A | A | |
| EXAMPLE3 | THIS METHOD | 0.15 | 1.2 | 1.3 | 1.5 | 0.6 | 0.13 | 10 | A | A | A | A | |

FIG.3B

| | COATING METHOD | DIFFERENCE IN SOLUBILITY PARAMETER | INITIAL VISCOSITY RATIO OF UPPER LAYER TO LOWER LAYER (UPPER LAYER/LOWER LAYER) | Ca OF UPPER LAYER | Ca OF LOWER LAYER | DIFFERENCE IN SURFACE TENSION BETWEEN UPPER AND LOWER LAYERS [mN/m] | RATIO OF WET COATING THICKNESS OF UPPER LAYER TO DISTANCE TO SUPPORT | DISTANCE BETWEEN DISCHARGE NOZZLES OF ADJOINING DIES [mm] | WHITENING RESULTING FROM BLENDING OF LAYERS | STREAKS | STEPS | OVERALL RATING | REMARKS |
|---|---|---|---|---|---|---|---|---|---|---|---|---|---|
| COMPARATIVE EXAMPLE4 | THIS METHOD | 0.1 | 0.5 | 1.3 | 1.5 | 0.6 | 0.13 | 10 | A | F | F | F | Low-frequency steps |
| COMPARATIVE EXAMPLE5 | THIS METHOD | 0.1 | 0.8 | 1.3 | 1.5 | 0.6 | 0.13 | 10 | A | F | F | F | Low-frequency steps |
| COMPARATIVE EXAMPLE11 | THIS METHOD | 0.1 | 1 | 1.3 | 1.5 | 0.6 | 0.13 | 10 | A | F | F | F | Low-frequency steps |
| EXAMPLE5 | THIS METHOD | 0.1 | 1.1 | 1.3 | 1.5 | 0.6 | 0.13 | 10 | A | A | A | A | |
| COMPARATIVE EXAMPLE6 | THIS METHOD | 0.1 | 1.2 | 2 | 1.5 | 0.6 | 0.13 | 10 | A | F | F | F | No sharp streaks |
| COMPARATIVE EXAMPLE7 | THIS METHOD | 0.1 | 1.2 | 1.8 | 1.5 | 0.6 | 0.13 | 10 | A | F | F | F | No sharp streaks |

FIG.3C

| | COATING METHOD | DIFFERENCE IN SOLUBILITY PARAMETER | INITIAL VISCOSITY RATIO OF UPPER LAYER TO LOWER LAYER (UPPER LAYER/LOWER LAYER) | Ca OF UPPER LAYER | Ca OF LOWER LAYER | DIFFERENCE IN SURFACE TENSION BETWEEN UPPER AND LOWER LAYERS [mN/m] | RATIO OF WET COATING THICKNESS OF UPPER LAYER TO DISTANCE TO SUPPORT | DISTANCE BETWEEN DISCHARGE NOZZLES OF ADJOINING DIES [mm] | WHITENING RESULTING FROM BLENDING OF LAYERS | STREAKS | STEPS | OVERALL RATING | REMARKS |
|---|---|---|---|---|---|---|---|---|---|---|---|---|---|
| EXAMPLE6 | THIS METHOD | 0.1 | 1.2 | 1.6 | 1.5 | 0.6 | 0.13 | 10 | A | A | A | A | |
| EXAMPLE7 | THIS METHOD | 0.1 | 1.2 | 1.4 | 1.5 | 0.6 | 0.13 | 10 | A | A | A | A | |
| COMPARATIVE EXAMPLE8 | THIS METHOD | 0.1 | 1.2 | 1.3 | 2 | 0.6 | 0.13 | 10 | A | F | F | F | Low-frequency steps only, no sharp streaks |
| COMPARATIVE EXAMPLE9 | THIS METHOD | 0.1 | 1.2 | 1.3 | 1.8 | 0.6 | 0.13 | 10 | A | F | F | F | Low-frequency steps only, no sharp streaks |
| EXAMPLE8 | THIS METHOD | 0.1 | 1.2 | 1.3 | 1.6 | 0.6 | 0.13 | 10 | A | A | A | A | |
| EXAMPLE9 | THIS METHOD | 0.1 | 1.2 | 1.3 | 1.4 | 0.6 | 0.13 | 10 | A | A | A | A | |

FIG.3D

| | COATING METHOD | DIFFERENCE IN SOLUBILITY PARAMETER | INITIAL VISCOSITY RATIO OF UPPER LAYER TO LOWER LAYER (UPPER LAYER/LOWER LAYER) | Ca OF UPPER LAYER | Ca OF LOWER LAYER | DIFFERENCE IN SURFACE TENSION BETWEEN UPPER AND LOWER LAYERS [mN/m] | RATIO OF WET COATING THICKNESS OF UPPER LAYER TO DISTANCE TO SUPPORT | DISTANCE BETWEEN DISCHARGE NOZZLES OF ADJOINING SITES [mm] | WHITENING RESULTING FROM BLENDING OF LAYERS | STREAKS | STEPS | OVERALL RATING | REMARKS |
|---|---|---|---|---|---|---|---|---|---|---|---|---|---|
| COMPARATIVE EXAMPLE10 | THIS METHOD | 0.1 | 1.2 | 1.3 | 1.5 | 0.4 | 0.13 | 10 | A | F | F | F | |
| EXAMPLE10 | THIS METHOD | 0.1 | 1.2 | 1.3 | 1.5 | 1 | 0.13 | 10 | A | A | A | A | |
| EXAMPLE11 | THIS METHOD | 0.1 | 1.2 | 1.3 | 1.5 | 2 | 0.13 | 10 | A | A | A | A | |
| COMPARATIVE EXAMPLE12 | THIS METHOD | 0.1 | 1.2 | 1.3 | 1.5 | 0.6 | 0.16 | 10 | A | F | B | F | Zonal streaks due to coating Ca |
| COMPARATIVE EXAMPLE13 | THIS METHOD | 0.1 | 1.2 | 1.3 | 1.5 | 0.6 | 0.2 | 10 | A | F | B | F | Zonal streaks due to coating Ca |

FIG.3E

| | COATING METHOD | DIFFERENCE IN SOLUBILITY PARAMETER | INITIAL VISCOSITY RATIO OF UPPER LAYER TO LOWER LAYER (UPPER LAYER/LOWER LAYER) | Ca OF UPPER LAYER | Ca OF LOWER LAYER | DIFFERENCE IN SURFACE TENSION BETWEEN UPPER AND LOWER LAYERS [mN/m] | RATIO OF WET COATING THICKNESS OF UPPER LAYER TO DISTANCE TO SUPPORT | DISTANCE BETWEEN DISCHARGE NOZZLES OF ADJOINING DIES [mm] | WHITENING RESULTING FROM BLENDING OF LAYERS | STREAKS | STEPS | OVERALL RATING | REMARKS |
|---|---|---|---|---|---|---|---|---|---|---|---|---|---|
| EXAMPLE12 | THIS METHOD | 0.1 | 1.2 | 1.3 | 1.5 | 0.6 | 0.1 | 10 | A | A | A | A | |
| EXAMPLE13 | THIS METHOD | 0.1 | 1.2 | 1.3 | 1.5 | 0.6 | 0.05 | 10 | A | A | A | A | |
| COMPARATIVE EXAMPLE14 | THIS METHOD | 0.1 | 1.2 | 1.3 | 1.5 | 0.6 | 0.13 | 0 | A | F | B | F | Sharp streaks due to interval between discharge nozzles of dies |
| COMPARATIVE EXAMPLE15 | THIS METHOD | 0.1 | 1.2 | 1.3 | 1.5 | 0.6 | 0.16 | 1 | A | B | B | F | Sharp streaks due to interval between discharge nozzles of dies |
| COMPARATIVE EXAMPLE16 | THIS METHOD | 0.1 | 1.2 | 1.3 | 1.5 | 0.6 | 0.16 | 550 | A | B | B | F | Windblown streaks due to interval between discharge nozzles of dies |
| COMPARATIVE EXAMPLE17 | THIS METHOD | 0.1 | 1.2 | 1.3 | 1.5 | 0.6 | 0.16 | 850 | A | F | B | F | Windblown streaks due to interval between discharge nozzles of dies |

METHOD OF PRODUCING LAMINATE FILM

BACKGROUND OF THE INVENTION

1. Field of the Invention

The presently disclosed subject matter relates to a method of producing a laminate film and, in particular, to a method of coating for producing a laminate film including coating a continuously traveling support with coating solutions each containing one or more monomers or polymers by using at least two monolayer extrusion dies to provide layers.

2. Description of the Related Art

Antireflection films are used for various picture display units such as a liquid crystal display (LCD), a plasma display panel (PDP), an electro luminescent display (ELD), and a cathode-ray-tube display (CRT).

Methods of forming antireflection films by coating have been proposed.

For example, Japanese Patent No. 3314965 proposes an abrasion-resistant anti-glare film wherein abrasion-resistance is attained drying to touch or semi-curing a coating film applied on a support, laminating another coating film on the semi-cured coating film, and curing the two layers of coating films simultaneously.

This technique enhances, but still insufficiently, abrasion resistance. Moreover, since the dried to touch or semi-cured coating film has a low film hardness, the film tends to be scarred during handling. In addition, productivity of multi-layer films is sometimes low, because the coating steps need to be repeated more than once.

Japanese Patent Application Laid-Open No. 8-168719 discloses that a high-speed and stable thin film coating can be achieved, provided that a dimensionless number called Capillary Number Ca satisfies the following condition:

$$Ca=\mu\cdot U/\sigma\leq 0.3$$

where U [cm/sec] is a coating speed, μ [P] is a viscosity of a coating solution, and σ [dyne/cm] is a surface tension of the coating solution.

Japanese Patent Application Laid-Open No. 2003-260400 discloses that in simultaneous coating of multiple layers comprising at least two layers formed by coating, at least one forefront lip other than the forefront lip disposed at the most upstream side in the traveling direction of the web has a flat part with a length of 30 μm or more and 100 μm or less in the traveling direction of the web.

SUMMARY OF THE INVENTION

However, layers made by coating in superposition described above have coating unevenness caused by a turbulent interface (turbulence of a boundary face). The coating unevenness caused by a turbulent interface is classified into whitening resulting from blending of coating solutions at the interface, streaks, and steps.

In view of such circumstances, it is an object of the presently disclosed subject matter to provide a method of producing a laminate film including coating a continuously traveling support with coating solutions each containing one or more monomers or polymers to provide layers, which can prevent coating unevenness caused by a turbulent interface.

In order to achieve the object, the presently disclosed subject matter provides a method of coating for producing a laminate film including coating a continuously traveling support with coating solutions each containing one or more monomers or polymers with at least two monolayer extrusion dies to provide layers; wherein a difference in solubility parameter between the coating solution and a solute in the adjoining layer is not smaller than 0.1 for the respective coating solutions; a viscosity of the coating solution discharged from a downstream side die is lower than that of the coating solution discharged from an upstream side die for the adjoining layers; each of the coating solutions has a Capillary number Ca which satisfies Ca<1.7; a difference in surface tension $|\sigma2-\sigma1|$ between the adjoining layers satisfies $|\sigma2-\sigma1|>0.5$ [mN/m], where σ1 is a surface tension of the coating solution discharged from the upstream side die and σ2 is a surface tension of the coating solution discharged from the downstream side die; a ratio $h_1/L$ between a coating thickness $h_1$ [μm] of the coating solution for an upper layer and a distance L [μm] of the upper layer from the support surface satisfies $h_1/L<0.14$; and a distance M between discharge nozzles of the adjoining monolayer extrusion dies is 1 mm or more and 700 mm or less.

In the presently disclosed subject matter, (A) monolayer extrusion dies are used instead of a die for simultaneous multi-layer coating for coating a continuously traveling support with coating solutions each containing one or more monomers or polymers. (B) An interval of the monolayer extrusion dies for applying the coating solutions is determined so as to have a distance M between the discharge nozzles of the adjoining monolayer extrusion dies being 1 mm or more and 700 mm or less.

Furthermore, for the respective coating solutions, (C) a difference in solubility parameter between the coating solution and a solute in the adjoining layer is not smaller than 0.1 for the respective coating solutions; (D) a viscosity of the coating solution discharged from a downstream side die is lower than that of the coating solution discharged from an upstream side die for the adjoining layers; (E) each of the coating solutions has a Capillary number Ca which satisfies Ca<1.7; (F) a difference in surface tension $|\sigma2-\sigma1|$ between the adjoining layers satisfies $|\sigma2-\sigma1|>0.5$ [mN/m], where σ1 is a surface tension of the coating solution discharged from the upstream side die and σ2 is a surface tension of the coating solution discharged from the downstream side die; and (G) a ratio $h_1/L$ between a coating thickness $h_1$ [μm] of the coating solution for an upper layer and a distance L [μm] of the upper layer from the support surface satisfies $h_1/L<0.14$.

According to the presently disclosed subject matter, satisfying all the conditions, prevented by coating layers, coating unevenness caused by a turbulent interface of the layers can be.

In the presently disclosed subject matter, preferably the difference in surface tension $|\sigma2-\sigma1|$ in (F) satisfies 0.5 [mN/m]<$|\sigma2-\sigma1|$<15 [mN/m]. Preferably the distance M between discharge nozzles in (B) is 2 mm or more and 500 mm or less.

Since a laminate film produced by the method of producing a laminate film of the presently disclosed subject matter has no coating unevenness, the method is suitable for making optical films or antireflection films.

The presently disclosed subject matter can provide method of producing a laminate film including coating a continuously traveling support with coating solutions each containing one or more monomers to provide layers, which can prevent coating unevenness caused by a turbulent interface.

BRIEF DESCRIPTION OF THE DRAWINGS

FIGS. 3A to 3E are tables illustrating results of Examples.

DETAILED DESCRIPTION OF THE PREFERRED EMBODIMENTS

Preferred embodiments of the method of producing a laminate film of the presently disclosed subject matter are described below.

Figure 1A:
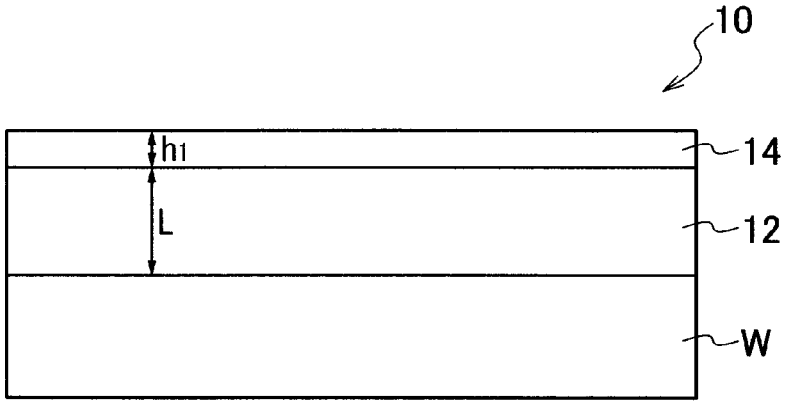
FIGS. 1A, 1B and 1C illustrate schematic cross-sectional views of a laminate film according to the presently disclosed subject matter.
Figure 1B:
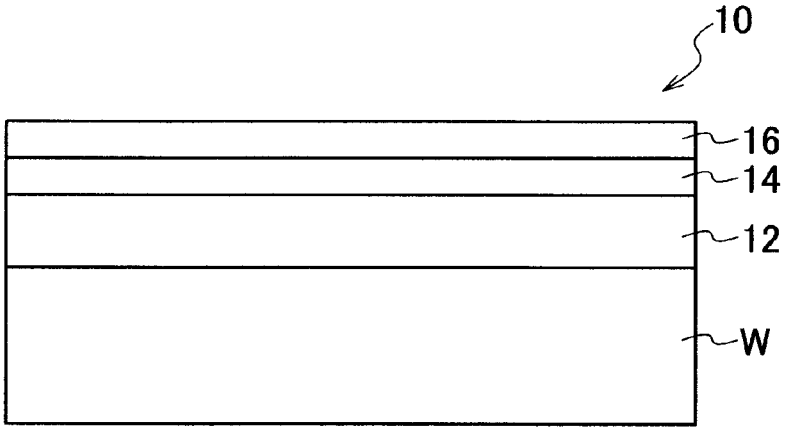
Figure 1C:
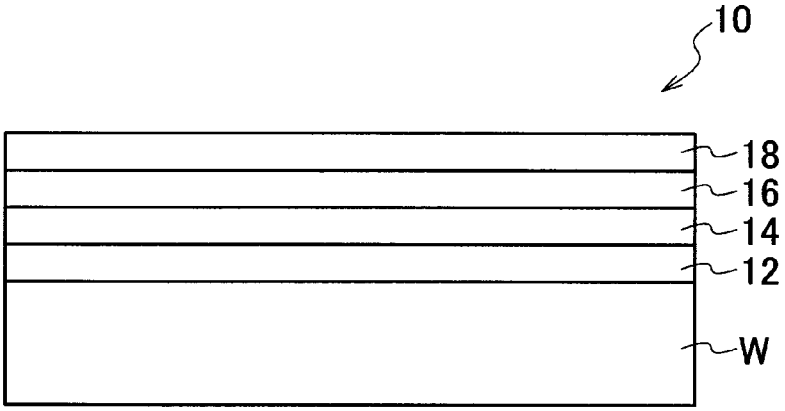

Laminate films according to the presently disclosed subject matter may have layer configurations such as a following representative examples:

a: support/hard coat layer/low refractive index layer (FIG. 1A);

b: support/hard coat layer/high refractive index layer/low refractive index layer (FIG. 1B); and c: support/hard coat layer/intermediate refractive index layer/high refractive index layer/low refractive index layer (FIG. 1C).

As illustrated in FIG. 1A, a laminate film 10 according to the presently disclosed subject matter produced by coating a support W with a hard coat layer 12 and subsequently laminating a low refractive index layer 14 on the hard coat layer 12 can be favorably used as an antireflection film. The low refractive index layer 14 having a thickness of about ¼ of a light wavelength formed on the hard coat layer 12 can reduce surface reflection due to the principle of thin-film interference.

Alternatively, as illustrated in FIG. 1B, a laminate film made by coating a support W with a hard coat layer 12 and subsequently laminating a high refractive index layer 14 and a low refractive index layer 16 on the hard coat layer 12 can be favorably used as an antireflection film.

Alternatively, as illustrated in FIG. 1C, a support W, a hard coat layer 12, an intermediate refractive index layer 14, a high refractive index layer 16, and a low refractive index layer 18 may be laminated in sequence to achieve a reflectance of not higher than 1%.

Figure 2:
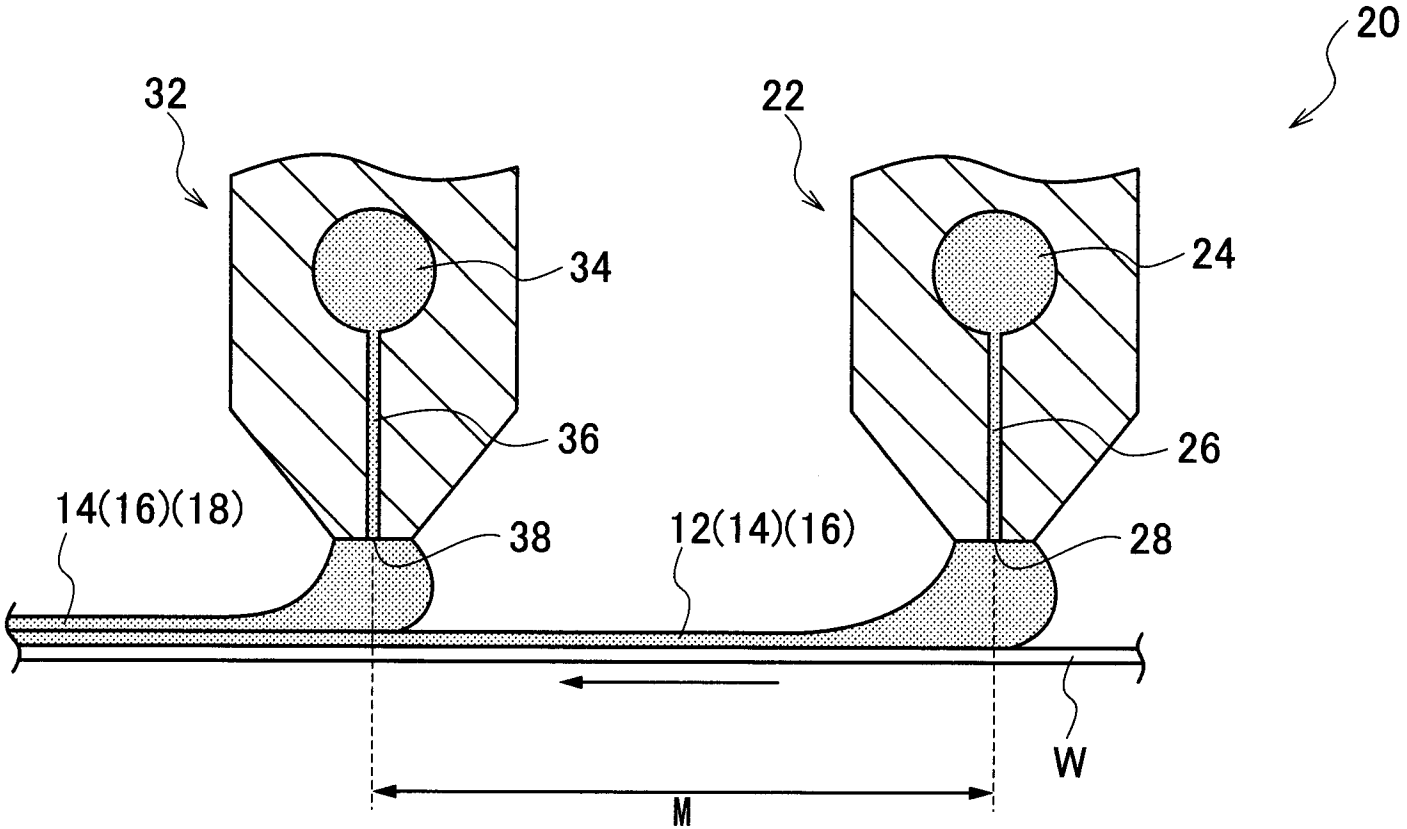
FIG. 2 illustrates a method of making a laminate film according to the presently disclosed subject matter.

FIG. 2 illustrates an overall configuration of an exemplary coating device having monolayer extrusion dies used for the coating method of the presently disclosed subject matter. In this example, a web (support) W is coated with two kinds of coating solutions by using two monolayer extrusion dies for the multilayer coating.

As illustrated in FIG. 2, a coating device 20 for a laminate film includes a continuously traveling web W and two monolayer extrusion dies 22 and 32 for coating the web W with coating solutions.

The case where the laminate film illustrated in FIG. 1A is produced is described below. The monolayer extrusion dies 22 and 32 have built-in pockets 24 and 34 in parallel with the width direction of the web W, respectively. Each of the pockets 24 and 34 is connected with a corresponding coating solution tank storing one of the two kinds of coating solutions via a metering pump through piping (not illustrated). The coating solutions 12 and 14 are supplied from the coating solution tanks to the respective pockets 24 and 34 to be widened to a coating width. The two kinds of coating solutions 12 and 14 widened in the respective pockets 24 and 34 are discharged from discharge nozzles 28 and 38 via slits 26 and 36 to coat the web W, respectively.

Alternatively, when the laminate film illustrated in FIG. 1C is produced, the two kinds of coating solutions 12 and 14 may be replaced by coating solutions 14 and 16 for the intermediate refractive index layer 14 and the high refractive index layer 16 respectively or may be replaced by coating solutions 16 and 18 for the high refractive index layer 16 and the low refractive index layer 18 respectively.

In other words, an coating solution for forming a lower layer is discharged from the monolayer extrusion die 22 disposed at an upstream side in the web traveling direction and an coating solution for forming an upper layer is discharged from the monolayer extrusion die 32 disposed at a downstream side, so that a two-layer laminate composed of the upper layer and the lower layer is formed on the web 12.

In the presently disclosed subject matter, an interval of the monolayer extrusion dies for applying the coating solutions is determined so as to have a distance M between the discharge nozzles of adjoining monolayer extrusion dies of 1 mm or more and 700 mm or less. Preferably the distance M between the discharge nozzles is from 2 mm or more and 500 mm or less.

In the presently disclosed subject matter, the coating solutions are selected so as to have mutually different solubility parameters of solutes in the respective adjoining layers in the laminate of not lower than 0.1.

The coating solution for the adjoining layer discharged from a downstream side is selected so as to have a lower viscosity than the coating solution discharged from an upstream side.

Each of the coating solutions is constituted for coating so as to have a Capillary number Ca of each coating solution, which is calculated from the following equation (1), satisfying $Ca<1.7$.

$$Ca=\mu\cdot U/\sigma \quad (1)$$

where μ: an average high shear viscosity of coating solution [Pa·s], U: a traveling speed of web [m/s], σ: a surface tension [N/m] of coating solution for the uppermost layer of multilayer-coated layers.

The coating solutions are selected, such that a difference in surface tension $|\sigma2-\sigma1|$ between the adjoining layers is $|\sigma2-\sigma1|>0.5$ [mN/m], where σ1 is the surface tension of the coating solution discharged from an upstream side and σ2 is the surface tension of the coating solution discharged from a downstream side. Preferably the difference in surface tension $|\sigma2-\sigma1|$ satisfies $0.5\ [mN/m]<|\sigma2-\sigma1|<15\ [mN/m]$.

Coating is performed so as to satisfy $h_1/L<0.14$, where $h_1$ [μm] is a coating thickness of the coating solution for an upper layer and L [μm] is a distance between the upper layer and the support surface.

When a laminate film is produced by using the coating device 20 illustrated in FIG. 2 under these conditions, coating unevenness caused by a turbulent interface of the laminate associated with simultaneous coating of multiple layers can be prevented. Accordingly, a laminate film produced by the method of producing a laminate film according to the presently disclosed subject matter can provide a laminate without coating unevenness.

An optical film or antireflection film according to the presently disclosed subject matter is described below. Although laminate films of the presently disclosed subject matter may be formed by the method described below, the presently disclosed subject matter is not limited to this method.

(1) Preparation of Coating Solutions

<Formulation>

An exemplary case is described below.

(Upper Layer (Low Refractive Index Layer))

Surface of hollow silica particles having an average particle diameter of 20 nm were treated with 3,3,3-trifluoropropylmethyl dichlorosilane to hydrophobize the surface of the particles. The following composition was dissolved in 82 parts by mass of methyl ethyl keton to prepare a coating solution. The critical solid content concentration of this system is 71%.

Acrylic resin: 15 parts by mass

Hydrophobic particles: 0.2 parts by mass

The above was used for coating with an amount of 3.5 cc/m$^2$ to 5 cc/m$^2$.

Lower Layer

Anti-Glare Layer

Synthesis Example 1

Preparation of Organosilane Compound (OS) Solution

120 Parts by mass of methyl ethyl keton, 100 parts by mass of 3-acryloxypropyl trimethoxy silane "KBM-5103" made by Shin-Etsu Chemical Co., Ltd., 3 parts by mass of di-isopropoxy aluminum ethyl acetoacetate were placed in a reactor equipped with a stirring machine and a reflux condenser for blending. Subsequently, 30 parts by mass of ion-exchanged water was added to develop a reaction at 60° C. for four hours. By subsequent cooling to room temperature, the organosilane compound (OS) solution was obtained. The mass-average molecular weight was 1600. The polymerized constituents, including oligomers, which have a molecular weight ranging from 1000 to 20000 accounted for 100%. Analysis by gas chromatography showed that source 3-acryloxypropyl trimethoxy silane scarcely remained.

[Preparation of Coating Composition for Anti-Glare Layer (H-1)]

A container equipped with a stirring machine was filled with 31.0 parts by mass of dipentaerythritol hexaacrylate-modified polyfunctional acrylate monomer "Kayarad DPCA-120" made by Nippon Kayaku Co., Ltd. Subsequently, 1.5 parts by mass of a polymerization initiator "Irgacure 184" made by Chiba Specialty Chemicals K.K., 0.04 parts by mass of the undermentioned fluorochemical surface reformer (F-12), 6.2 parts by mass of an organosilane compound "KBM-5103" made by Shin-Etsu Chemical Co., Ltd., and 31.0 parts by mass of methyl isobutyl keton were added and stirred. After coating with this solution, the coating film was ultraviolet-cured. The cured film had a refractive index of 1.52.

Fluorochemical Surface Reformer (F-12):

[Formula 1]

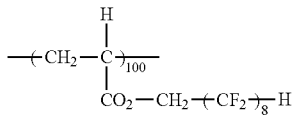

Bridged poly(acrylic-styrene) particles having an average particle diameter of 3.5 μm (a copolymer composition ratio of 50/50, and a refractive index of 1.540) were dispersed by a Polytron disperser at 10000 rpm for 20 minutes to make a 30% by mass cyclohexanone dispersion. 10.0 parts by mass of this dispersion was further added to the blended liquid and stirred. The liquid was filtrated through a polypropylene filter having a pore diameter of 30 μm to prepare a coating composition (H-1) for an anti-glare layer.

The above was used for coating with an amount of 14 cc/m$^2$ to 30 cc/m$^2$.

<Preparation>

In the beginning, the coating solutions containing constituents for forming the respective layers are prepared. An increase in water content in the coating solutions is prevented by minimizing a volatization volume of the solvent. The preferred water content in the coating solution is not higher than 5%, and more preferred is not higher than 2%. The suppression of a volatization volume of the solvent is achieved by enhancing sealing during stirring materials supplied to the tanks and by minimizing air contact area of the coating solution during transferring. Alternatively, a device for reducing water content in the coating solution during coating or before or after coating may be provided.

<Filtration>

Preferably the coating solution for use in coating is filtrated before coating. The preferred filter has a pore diameter as small as possible, provided that constituents of the coating solution are not removed. For filtration, a filter having an absolute filtration rate of 0.1 μm to 50 μm is used. Preferably a filter having an absolute measure of precision of filtration of 0.1 μm to 40 μm is used. The preferred thickness of the filter ranges from 0.1 mm to 10 mm. The more preferred thickness ranges from 0.2 mm to 2 mm. A filtration pressure is preferably not higher than 1.5 MPa, more preferably not higher than 1.0 MPa, and further preferably not higher than 0.2 MPa.

A filter member for filtration is not specifically limited provided that the member does not affect the coating solution. In particular, examples include the same member as that is used for filtering the wet dispersed inorganic compounds as described above. It is also preferred to disperse the filtered coating solution by ultrasonic process just prior to coating for defoaming or for supplementarily keeping the dispersion state of the coating solution.

(2) Drying

Preferably a film of the presently disclosed subject matter that coats a support is conveyed with a web to a heated zone for dying the solvent.

Variety of methods of drying the solvent is available. In particular, examples include Japanese Patent Application Laid-Open Nos. 2001-286817, No. 2001-314798, No. 2003-126768, No. 2003-315505, and No. 2004-034002.

Preferably the drying zone has a temperature ranging from 25° C. to 140° C., with a first half zone having relatively low temperatures and a second half zone having relatively high temperatures. However, the preferred temperature range is not higher than a temperature at which a constituent contained in the coating compositions of the layers except for the solvents begins to vaporize. For example, a certain type of commercial photo radical generator used together with ultraviolet curable resins vaporizes several tens of percent in the hot air at 120° C. within a few minutes, and certain monofunctional or difunctional acrylate monomers vaporize in the hot air at 100° C. In these cases, the preferred temperature range of the drying zone is not higher than a temperature at which a constituent, except for the solvents, contained in the coating compositions of the layers begins to vaporize as described above.

After the support is coated with the coating compositions of the respective layers, the drying wind preferably has a velocity at the surface of a coating film ranging from 0.1 m/s to 2 m/s during the solid content concentrations in the coating compositions ranging from 1% to 50% in order to prevent the unevenness caused by drying.

After the support is coated with the coating compositions of the respective layers, the difference in temperature in the drying zone between a conveying roll having contact with the opposite surface to the coated surface of the support and the support is preferably controlled within 0° C. to 20° C. in order to prevent the unevenness by drying resulting from the uneven heat transfer on the conveying roll.

(3) Curing

In the film of the presently disclosed subject matter, after the solvents are dried, coating films pass through a zone where the respective coating films can be cured by ionized radiation and/or heating with a web.

In the presently disclosed subject matter, the type of the ionized radiation is not specifically limited. Depending on the kind of curable compositions forming the film, an appropriate ionized radiation may be selected from ultraviolet rays, electron beams, near-ultraviolet rays, visible light, near-infrared rays, infrared rays, and X-rays. The preferred source is ultraviolet rays or electron beams. Ultraviolet rays are more preferable due to easiness in producing high energy with easy handling.

As a light source of ultraviolet rays for photo polymerization of UV-reactive compounds, any light sources that generate ultraviolet rays may be used. For example, a low pressure mercury lamp, an intermediate pressure mercury lamp, a high pressure mercury lamp, an ultrahigh pressure mercury lamp, a carbon-arc lamp, a metal halide lamp, and a xenon lamp may be used. An ArF excimer laser, a KrF excimer laser, an excimer lamp or synchrotron radiation also may be used. Among these, an ultra high pressure mercury lamp, a high pressure mercury lamp, a low pressure mercury lamp, a carbon arc, a xenon arc, and a metal halide lamp are preferably used.

Electron beams may be used as well. Examples may include electron beams having an energy range of 50 keV to 1000 keV, preferably 100 keV to 300 keV, which are emitted from an electron beam accelerator of variety of types, such as a Cockcroft-Walton type, a bandegraph type, a resonance transformer, an insulation core transformer, a linear type, a Dynamitron type, and a high frequency type.

Although irradiation conditions depend on lamps, the intensity of irradiation is preferably not lower than 10 $mJ/cm^2$, more preferably in the range from 50 $mJ/cm^2$ to 10000 $mJ/cm^2$, particularly preferably in the range from 50 $mJ/cm^2$ to 2000 $mJ/cm^2$. In addition, the irradiation intensity along the width direction of the web including the both ends is distributed preferably in the range from 50% to 100%, more preferably in the range from 80% to 100% with maximum irradiation intensity at the center.

Cross-linking reactions or polymerization reactions of ionized radiation curable compounds are performed in the atmosphere having an oxygen concentration of preferably not higher than 6% by volume, more preferably not higher than 4% by volume, particularly preferably not higher than 2% by volume, and most preferably not higher than 1% by volume. However, reducing oxygen concentration beyond necessity is unfavorable from a stand point of manufacturing cost, because a large amount of inert gas such as nitrogen is required.

During curing, the film surface is heated at a temperature preferably ranging from 60° C. or more and 170° C. or less, more preferably from 60° C. to 100° C. The temperature of the film surface means the temperature of the film surface of a layer that is to be cured. The time required for the film to reach the temperature is preferably in the range from 0.1 second or more and 300 seconds or less, more preferably not more than 10 seconds.

Although the heating method is not specifically limited, a method by using heated rolls contacting with a film, a method by blowing heated nitrogen, or a method by irradiation of far-infrared rays or infrared rays is preferably used. Rotating metal rolls as described in Japanese Patent No. 2523574 may be heated by a medium such as hot water, steam, or oil passing through the rolls. Alternatively, rolls heated by dielectric heating may be used as a heating device.

(4) Handling

For continuous production of films of the presently disclosed subject matter, a step of continuously feeding a support film from a roll, a step of coating the support film with coating solutions and drying it, a step of curing coating films, and a step of reeling the support film with cured layers are performed.

A film support from a roll is continuously fed to a clean room, where static electricity charged on the film support is eliminated by a static eraser and foreign substances still attaching to the film support are removed by a dust controller. Subsequently, the film support is coated with a coating solution in a coating compartment disposed in the clean room. The coated film support is conveyed to a drying room for drying.

The film support having a dried coating layer is conveyed from a drying room to a curing room, where monomers contained in the coating layer are polymerized and cured. Subsequently, the film support having cured layers is conveyed to a curing compartment to complete curing. The film support having a completely cured layer is reeled to make a roll.

In order to make a film of the presently disclosed subject matter, in simultaneous with precision filtering of the coating solution as described above, preferably the step of coating in the coating compartment and the step of drying in the drying room are performed in the air atmosphere of high cleanliness level and dust and dirt on the film are sufficiently removed before coating is performed. The cleanliness level of the air in the steps of coating and drying is preferably US Federal Standard 209E class 10 (number of particles of 0.5 μm or larger is not more than 353 per cubic meter) or cleaner, more preferably class 1 (the number of particles of 0.5 μm or larger is not more than 35.5 per cubic meter) or cleaner. Preferably the cleanliness level of the air is also high in feeding or reeling compartment used in other steps than the steps of coating and drying.

(5) Saponification

In the case of making a polarization plate by using a film of the presently disclosed subject matter as one of the two surface-protective films for a polarization film, the surface that is to be laminated with the polarization film is preferably hydrophilized for adhesion improvement in an adhesion surface.

(a) Method by Immersion in Alkali Solution

In this method, the film is immersed in an alkali solution under proper conditions to saponify entire surfaces reactive to alkali. The method is preferred from a cost standpoint, since no special facility is required. The preferred alkali solution is aqueous solution of sodium hydroxide. The concentration is preferably in the range from 0.5 mol/L to 3 mol/L, particularly preferably from 1 mol/L to 2 mol/L. The temperature of the alkali solution is preferably in the range from 30° C. to 75° C., particularly preferably from 40° C. to 60° C.

Although a combination of relatively mild conditions of saponification is preferred for the combination of saponification conditions described above, the conditions may be set depending on material and configuration of the film and a target angle of contact.

After immersion in alkali solution, preferably the alkaline component is sufficiently washed away with water so as not to remain in the film, or the film is immersed in dilute acid for neutralizing the alkali component.

A surface opposite to the surface having the coating layers is hydrophilized by the saponification. The hydrophilized surface of the transparent support is contacted with a polarization film for use in a protective film for a polarization plate.

The hydrophilized surface effectively enhances adhesion to an adhesion layer mainly composed of polyvinyl alcohol.

In the saponification, a lower contact angle of water on a surface of the transparent support opposite to the surface having the coating layers is preferable from a stand point of the adhesion to a polarization film. However, immersion in alkali solution damages the surface and inner portion of the coating layers at the same time. Accordingly, it is important to keep the reaction conditions to the minimum necessity. The contact angle of water on the opposite surface of the transparent support can be used as an indicator of damage that the layers sustain from alkali. In the case of triacetylcellulose transparent support, the contact angle is preferably in the range from 10 degrees to 50 degrees, more preferably from 30 degrees to 50 degrees, further preferably from 40 degrees to 50 degrees. A contact angle of not smaller than 50 degrees is not preferred, because a problem occurs in adhesion to the polarization film. A contact angle of smaller than 10 degrees is not preferred either, because of damaging physical strength of the film that sustains too much damage.

(b) Method by Coating with Alkali Solution

In order to avoid the damage to the films in the method by immersion, a method by coating with alkali solution is preferably used. In the method, only the surface opposite to the surface having the coating layers is coated with alkali solution, heated, washed with water, and dried in proper conditions. Coating in this method means bringing the surface to be saponified in contact with alkali solution, including spraying or contacting with a belt containing the solution, in addition to coating. Since facilities and steps are required for coating with alkali solution, this method is less advantageous from a stand point of costs compared to the method by immersion described in (a). In contrast, since only the surface to be saponified is brought in contact with alkali solution, the opposite surface may have a layer composed of material that is readily attacked by alkali solution. For example, a vapor-deposited film or a sol-gel film is decomposed, dissolved, or peeled by alkali solution. Accordingly, although the method by immersion is unfavorable for such a film, the method by coating can be used without a problem because there is no contact with alkali solution.

In both of the saponification methods (a) and (b), the saponification can be performed after forming layers on the support drawn from a roll. Accordingly, a step of saponification may be added to the steps of producing films in a continuous operation. Further, laminating polarization plate composed of a support drawn from a roll may be also continuously performed at the same time. As a result, a polarization plate can be more efficiently made compared to a sheet-feed operation.

(c) Method of Saponification Using a Protective Laminate Film

When a coating layer is insufficiently resistant to an alkali solution, this method may be used as in the case of the method (b). After forming a final layer, a laminate film is laminated on the surface having the final layer for immersing in alkali solution to hydrophilize only a triacetylcellulose surface opposite to the surface having the final layer. Subsequently, the laminate film is peeled off. This method also can hydrophilize enough for a protective film for a polarization plate only a triacetylcellulose film surface opposite to the surface having the final layer without damage to the coating layers. Advantage over the method (b) is that special facilities for coating with alkali solution are not required, although the laminate film generates waste.

(d) Method by Immersion in Alkali Solution after Forming an Intermediate Layer

In the case of lower layers having resistance to alkali solution and upper layers having insufficient resistance to alkali solution, the formed lower layers may be immersed in alkali solution to hydrophilize both surfaces. Subsequently the upper layers can be formed. Although production process is complicated, the method may be used for making a film composed of an anti-glare layer and a low refractive index layer of a sol-gel film containing fluorine, for example. Advantage is that the surface having hydrophilic groups can enhance adhesion between the anti-glare layer and the low refractive index layer.

(e) Method by Forming Coating Layers on a Pre-Saponified Triacetylcellulose Film A triacetylcellulose film is preliminarily immersed in alkali solution for saponification. Subsequently, coating layers are formed directly or via another layer on one of the surfaces. In the case of saponification by immersion in alkali solution, adhesion between the triacetylcellulose surface that is hydrophilized by saponification and a coating layer is degraded in certain instances. To deal with the problem, corona discharge treatment or glow discharge treatment may be performed only for the surface having a coating layer after saponification to form a coating layer after removal of a hydrophilized surface. When the coating layer has hydrophilic groups, enhanced adhesion is produced between the layers in certain instances.

(6) Making of Polarization Plate

A polarization plate may be made by using a film of the presently disclosed subject matter as a protective film disposed on one or both sides of a polarization film.

When a film of the presently disclosed subject matter is used as a protective film on one side, a conventional cellulose acetate film may be used as another protective film. Preferably a cellulose acetate film produced by solution coating as described above and stretched in the width direction of the rolled film with a draw ratio in the range from 10% to 100% is used as another protective film, though.

In addition, in a polarization plate of the presently disclosed subject matter, preferably one surface is an antireflection film and another surface is a protective film of an optical compensation film having an optical anisotropy layer made of a liquid crystal compound.

Examples of polarization films include an iodine polarization film, a dichroic dye polarization film, and a polyene polarization film. Iodine polarization films and dye polarization films are commonly produced by using polyvinyl alcohol film.

The slow axis of the transparent support of an antireflection film or a cellulose acetate film and the transmission axis of the polarization film are disposed substantially in parallel.

(7) Usage Form of the Presently Disclosed Subject Matter

Laminate films of the presently disclosed subject matter are used for various picture display units such as a liquid crystal display (LCD), a plasma display panel (PDP), an electro luminescent display (ELD), and a cathode-ray-tube display (CRT). Optical films according to the presently disclosed subject matter can be used on known displays such as a plasma display panel (PDP) and a cathode-ray-tube display (CRT).

(8) Support

A support (web) of a film of the presently disclosed subject matter is not specifically limited. Examples include a transparent resin film, a transparent resin board, a transparent resin sheet, and a transparent glass. A transparent resin film such as a cellulose acylate film (e.g. cellulose triacetate film (refractive index: 1.48), a cellulose diacetate film, a cellulose acetate butylate film, or a cellulose acetate propionate film), a polyethylene terephthalate film, a polyether sulfone film, a polyacrylic resin film, a polyurethane resin film, a polyester film, a polycarbonate film, a polysulfone film, a polyether film, a polymethylpentene film, a polyetherketon film, or an acrylonitrile (methacrylonitrile) film may be used.

A support having a thickness in the range from 25 μm to 1000 μm can be usually used. Preferably the thickness is in the range from 25 μm to 250 μm, more preferably from 30 μm to 90 μm.

Although a support having an arbitrary width can be used, the width is usually in the range from 100 mm to 5000 mm, preferably from 800 mm to 3000 mm, more preferably from 1000 mm to 2000 mm, considering handling, yield ratio, and productivity.

Preferably the surface of a support is flat and smooth. The average roughness Ra is preferably not larger than 1 μm, more preferably in the range from 0.0001 μm to 0.5 μm, furthermore preferably in the range from 0.001 μm to 0.1 μm.

Examples

Although the presently disclosed subject matter is further specifically described below as related to examples, the scope of the presently disclosed subject matter is not construed as being limited to the specific examples below.

A coating solution was prepared as described below. Triacetylcellulose (Fujitac made by Fujifilm Corporation) having a thickness of 80 μm was coated with the coating solution by using a coating device 20 for lamination films illustrated in FIG. 2. However, in Comparative Example 1, coating was performed by using a simultaneous multiple layer coating device.

Coating solutions having physical properties illustrated in FIG. 3 were used for the upper and lower layers.

In Example 1, coating solutions used were such that the difference in solubility parameter of solutes between upper and lower layers was 0.15, the coating solution discharged from a downstream side (upper layer) had a 1.2 times higher viscosity than that of the coating solution discharged from an upstream side (lower layer), the coating solutions for upper and lower layers had a Capillary number Ca of 1.3 and 1.5 respectively, and the difference in surface tension between the upper and lower layers was 0.6 [mN/m] as illustrated in Table in FIG. 3. In addition, coating conditions in Example 1 were such that the ratio of a coating thickness of the coating solution for the upper layer to a distance from the wave surface was 0.13, and a distance between the discharge nozzles of the adjoining dies was 10 [mm]

Similarly in Examples 2, 3 and 5 to 12 and Comparative examples 1 to 16, experiments were performed by using coating solutions and coating conditions illustrated in the table in FIGS. 3A to 3E.

Laminate films produced in Examples 1 to 3 and 5 to 12 and in Comparative examples 1 to 16 were inspected for whitening, streaks and steps. In columns: "WHITENING", "STEAKS" and "STEPS" of FIGS. 3A to 3E, Examples or Comparative examples which can manufacture laminate films having no whitening, steaks and steps, respectively are ranked as "A". Examples or Comparative examples which can manufacture laminate films having whitening, steaks and steps, respectively are ranked as "F". Examples or Comparative examples which can manufacture laminate films having lower degree of whitening, less steaks and steps than "F" rank, respectively are ranked as "B". In columns: "OVERALL RATING", Examples or Comparative examples which can manufacture laminate films having no whitening, streaks and steps are ranked as "A". Examples or Comparative examples which can manufacture laminate films having whitening, streaks and steps are ranked as "F". The results are illustrated in the table in FIGS. 3A to 3E.

As illustrated in Tables in FIGS. 3A to 3E, in Examples 1 to 3 and 5 to 12 that satisfy all the conditions of the presently disclosed subject matter, coating unevenness such as whitening, streaks, or steps was not found.

Accordingly, it is illustrated that the presently disclosed subject matter can provide a method of coating for producing a laminate film comprising coating a continuously traveling support with coating solutions each containing one or more monomers to provide layers, which can prevent coating unevenness caused by a turbulent interface.

What is claimed is:

1. A method of producing a laminate film comprising coating a continuously traveling support with coating solutions each containing one or more monomers or polymers with at least two monolayer extrusion dies to provide layers; wherein a difference in solubility parameter between the coating solution and a solute in the adjoining layer is not smaller than 0.1 for the respective coating solutions;

a viscosity of the coating solution discharged from a downstream side die is lower than that of the coating solution discharged from an upstream side die for the adjoining layers;

each of the coating solutions has a Capillary number Ca which satisfies a condition: $Ca<1.7$;

a difference in surface tension $|\sigma2-\sigma1|$ between the adjoining layers satisfies a condition: $|\sigma2-\sigma1|>0.5$ [mN/m], where $\sigma1$ is a surface tension of the coating solution discharged from the upstream side die and $\sigma2$ is a surface tension of the coating solution discharged from the downstream side die;

a ratio $h_1/L$ between a coating thickness $h_1$ [μm] of the coating solution for an upper layer of the adjoining layers and a distance L [μm] of the upper layer from the support surface satisfies a condition: $h_1/L<0.14$; and a distance M between discharge nozzles of the adjoining monolayer extrusion dies is 1 mm or more and 700 mm or less.

2. The method according to claim 1, wherein the difference in surface tension $|\sigma2-\sigma1|$ satisfies 0.5 [mN/m]$<|\sigma2-\sigma1|<$15 [mN/m].

3. The method according to claim 2, wherein the distance M between the discharge nozzles is 2 mm or more and 500 mm or less.

4. The method according to claim 1, wherein the distance M between the discharge nozzles is 2 mm or more and 500 mm or less.

5. The method of producing a laminate film, wherein the laminate film according to claim 1 is an optical film or an antireflection film.

6. The method according to claim 1, wherein the ratio $h_1/L$ is not smaller than 0.05.

* * * * *